US006702043B2

(12) United States Patent
Koch et al.

(10) Patent No.: US 6,702,043 B2
(45) Date of Patent: Mar. 9, 2004

(54) DRILLING MACHINE WITH ARC-LIKE DRILL PIPE HOLDER

(75) Inventors: Hubert Koch, Dortmund (DE); Karl-Robert Rohkamm, Kamen (DE); Josef Maus, Velen (DE); Gerald Labedski, Essen (DE); Rainer Finkenbusch, Waltrop (DE); Dieter Güde, Essen (DE)

(73) Assignee: Deilmann-Haniel Maschinen- und Stahlbau GmbH, Dortmund (DE)

( * ) Notice: Subject to any disclaimer, the term of this patent is extended or adjusted under 35 U.S.C. 154(b) by 71 days.

(21) Appl. No.: 10/079,409

(22) Filed: Feb. 22, 2002

(65) Prior Publication Data

US 2002/0117335 A1 Aug. 29, 2002

(30) Foreign Application Priority Data

Feb. 23, 2001 (DE) ..... 101 08 696

(51) Int. Cl.[7] ..... E21B 19/00
(52) U.S. Cl. ..... 175/52; 175/85; 414/22.61
(58) Field of Search ..... 175/52, 85; 414/22.62, 414/22.61, 22.51, 22.52

(56) References Cited

U.S. PATENT DOCUMENTS 6,085,852 A * 7/2000 Sparks et al. ..... 175/52
6,164,391 A * 12/2000 Wurm ..... 175/52
6,543,555 B2 * 4/2003 Casagrande ..... 175/85

* cited by examiner

*Primary Examiner*—David Bagnell
*Assistant Examiner*—Jennifer R Dougherty
(74) *Attorney, Agent, or Firm*—James Creighton Wray; Meera P. Narasimhan

(57) ABSTRACT

A drilling machine 1 with a drill pipe holder 10 to be operated automatically in boring as well as in pulling, disposes over a gripper 20, which is constructed rotatably about an axis 21 and beyond that also axially displaceably, and has a telescoping support arm 22. The pipes 8, 9 can be arranged, i.e. stored, inserted into one another in pipe depositories 11, 12, 13 forming a partial circle 15 and can also be pulled out of them and swiveled into the drilling axis 7 with the aid of the gripper 20. When pulling the drilling string, the pipes 8, 9 can then be individually fanned out into the pipe depositories 11, 12, 13 and then later on the outer pipes 8 can be slid over. The entire process is operated automatically with the gripper 20.

18 Claims, 6 Drawing Sheets

25
21
20
22
30
23
26
36
35
44
51
15
17
39,40
10
48
16
49
38
50
34
37
19
11
12
13
18

DRILLING MACHINE WITH ARC-LIKE DRILL PIPE HOLDER

BACKGROUND OF THE INVENTION

The invention concerns a drilling machine for doublehead or overlying drilling with a drill drive, a drilling unit for guiding it during longitudinal displacement, a pipe or a drill string consisting of outer and inner pipes as well as a drill pipe holder accommodating outer and inner pipes that fit into one another and having several pipe repositories, with a gripper transferring the pipes out of the drill pipe holder into the drilling axis and back being allocated to this drill pipe holder.

In mining operation, but also in other operations, drilling machines are used either for exploratory drilling in mountains or the underground or auger mining, or finally even also drilling in order to stabilize the underground in that solidification materials are pressed into the bore holes. For this drilling machines are used whose drill drive is moved back and forth on a drilling unit in order to generate the necessary counter pressure or thrust, while the drill drive operates in a rotating or rotating and striking manner. For overlying boring and for similar uses, double pipes are assembled as a drill string and introduced into the mountain. Since the individual outer and inner pipes in any given case are available only with a specified length, namely that of the drilling unit, an inner as well as an outer pipe must be connected to the drill string already situated in the mountain with corresponding advance in the drilling. Drill pipe holders, in which inner pipes are guided sliding into the outer pipes, serve for this. Inner and outer pipe are grasped simultaneously with the aid of a gripper and then pivoted into the drilling axis. A drilling machine is known from EP 0 565 502 in which the gripper moves in the x, in the y and in the z axis in order to swivel the double pipes into the drilling axis in this manner or to transfer them out of the drilling axis into the drill pipe holder. The known drill tube holder is constructed as a rectangle or square, whereby several double tubes are held in place in corresponding pipe depositories in each case, from which they are taken out with the grip member and appropriately pivoted. Here it is disadvantageous that with appropriate construction, both tubes are indeed grasped simultaneously by the grip member and swiveled into the drilling axis, but cannot be automatically brought back into the drill tube holder again during withdrawal. With the corresponding operation, the interior pipe is first 1 pulled altogether and in each case separated into segments and then deposited in the holder. Only later are the outer pipes also pulled, separated from each other and then brought into the drill pipe holder whereupon then, however, threading into each other is only possible by hand. This inhibits operations, quite apart from the fact that, owing to the weight of the individual pipes, these can only be handled at all up to a certain length. With longer pipe segments, special grippers must be used in order to place the pipes into one another and deposit them in the drill pipe holder. It is moreover disadvantageous that it is difficult to get close to the double pipes standing or deposited in the drill pipe holder with the gripper, because the gripper can only cover a specified distance. Although, pipe holders, for example, are also known on the basis of U.S. Pat. No. 5,556,253, in this case however not for double pipes, in which the pipes deposited one above the other in the drill pipe holder gradually slide into a position where they are grasped by the gripper and are brought into the drilling axis with an additional axial motion process and there are transferred to the drill drive or the drill string. This known gripper is, however, only usable on individual pipes. Were a double pipe consisting of outer and inner pipe to be grasped by the known gripper, no solution exists for how the gripper can grasp and then swivel both pipes separately. In addition, when filling the drill pipe holder, it is also necessary to operate manually even here, if one can conceive of it at all, in order to slide the outer pipe over the inner pipe or bring the inner pipe into the outer pipe.

SUMMARY OF THE INVENTION

Underlying the invention is therefore the task of creating a drilling machine with a drill pipe holder, which makes hand sorting of the pipes when drilling with outer and inner pipes superfluous.

The objective is accomplished in accordance with the invention in that the gripper is constructed rotatably about an axis and axially displaceably and has a telescoping supporting arm, and in that the drill pipe holder with its bag-shaped stationary pipe depositories is constructed and arranged about the axis of the gripper and at a distance thereto, forming a partial circle.

With a drilling machine constructed in this manner, it is possible when producing a bore hole to grasp separately the combined outer and inner pipes arranged in the drill pipe holder with the gripper and to swivel them together into the drilling axis in order then to connect them with the drill string or the drill drive. Since they are arranged correspondingly in the drill pipe holder, the gripper can grasp and appropriately swivel both in order to pull both tubes out of the drill pipe holder provided with the bag-shaped pipe depositories and then to rotate or pivot them into the drilling axis, while the gripper is able to rotate about the specified axis and axially displaceable in it during this process. The gripper can be brought to the pipe depository through the telescoping supporting arms in order to lock the outer and inner pipes into position and then take them out of the bag. These bag-shaped pipe depositories have the advantages that they not only fix the outer and inner pipes into position and that both can be grasped because the inner pipe projects somewhat out of the outer pipe, but it is also possible to arrange the inner pipes or outer pipes initially separate from each other in the drill pipe holder in order then to bring the still lacking pipe with the same gripper into the already deposited or about the already deposited pipe. This means that after drilling, all inner pipes can first be pulled out and separated from one another without difficulty, and then deposited in the drilling pipe holder before then pulling out the outer pipes as well after further operations, separating them from one another and then sliding an outer pipe over an inner pipe, whereby the gripper as depicted further above can carry out the corresponding operations because it is rotatable about the axis and at the same time axially displaceable. The drill pipe holder with its bag-shaped pipe depositories then ensures in this connection that the already inserted inner pipe is fixed in position and arranged such that one can also slide the outer pipe over it with the gripper. Both are then fixed in position in the pipe repository after arranging in the drill pipe holder such that it is possible without difficulty to grasp the two pipes again as needed with the gripper and to bring them correspondingly into operation.

According to a useful embodiment of the invention, it is provided that the axis of the gripper is arranged over the drilling unit beams but such that they are connected with it through cross beams, and is arranged displaceably on a sliding track allocated to the cross beams parallel to the drilling axis or the drilling unit beam. As already mentioned further above, it is therewith possible to pull the two pipes with the gripper out of the respectively allocated pipe repository, or possibly to place them back in there, individually or together, i.e. to insert them. Axis and drilling unit or drilling unit beams always have the same distance so that it is assured that when the gripper is appropriately rotated or swiveled about its axis, the pipes land exactly in the drilling axis, whereby corrections are also possible through appropriate construction of the gripper.

In order to ensure in a simple and useful manner that the two pipes, i.e. the outer and inner pipes, can be grasped separately by the gripper, it is provided that the bag-shaped pipe depositories in the drill pipe holder have a step mandrel opposite the inlet end for the pipes. This step mandrel ensures that the two pipes cannot be slid equally far into the bag or pipe depositories so that, for example, the inner pipe always projects a little bit beyond the outer pipe, and also that the pipes are stored in the bag such that they maintain a specified position so that they can be more securely fixed in place by the gripper and transported. The pipes are here appropriately fixed into position in the region of the step mandrel, that is at the lower end of the pipe repository or bag, but are at the same time braced against the inlet end of the pipe repository so that a specified position results to which the gripper can be set.

The inner pipe should protrude further out of the outer pipe because then the coupling with the drill drive is possible for which the invention provides that the step mandrel for the inner pipe has a stopper projecting further from the bag floor and is equipped with pipe guides. Through these guides, it is first assured that the inner pipe has a specified position so that the outer pipe can be more easily slid over. At the same time, however, the outer pipes are also still passed through appropriately.

The inner pipe is assigned a selected, predetermined position in that the step mandrel is constructed so as to guide the inner pipe on the bag wall. The step mandrel is shaped for this such that the inner pipe almost rests against the bag wall, thus at its deepest point, so that it always takes on the same position when it is slid into the bag or the pipe repository. As already mentioned above, in this way, sliding the outer pipe on is easier, but likewise, the exact position for the inner pipe is always maintained as well.

In order to be able to use inner pipes of various diameters, the invention provides that the step mandrel is connected interchangeably with the bag bottom so that by changing the step mandrel, allowance for the diameter of the inner pipe can advantageously be made.

It has already been pointed out several times that one and the same gripper is supposed to grasp and swivel the thicker outer pipe and the thinner inner pipe, whereby this is attained in that the gripper contains two pincers securely grasping pipes having different diameters at a distance to one another, which are at the same time constructed so as to be displaceable parallel to the drilling axis and actuatable separately or together. Owing to the possibility of moving the pincers or the gripper parallel to the drilling axis, pipes of different lengths can be securely processed whereby the separate actuatability ensures among other things that in this way both pipe diameters can be grasped and released practically simultaneously or likewise in a certain specified cycle.

Threading the pipes into the drill pipe holder, or better, into the bag-shaped pipe depositories is facilitated in that the bag of the pipe repository accommodating the pipes is widened, forming a funnel, at the end opposite the bag bottom. The pipes, that is, the thinner inner pipe as well as the thicker outer pipe, can thus be inserted without difficulty by the gripper into the drill pipe holder or into the pipe repository in order to be able to assume the specified position securely.

In order to preserve the outer pipe inside the pipe repository from shifts or other influences, it is provided that the bag wall is allocated adjusting elements fixing the outer pipe in place.

Positioning the individual pipes is facilitated in that the cylinders allocated to the grippers are constructed as three position cylinders with reserve stroke. Thus target positions can be exactly defined whereby corrections are possible without difficulty through reserve strokes. Through the reserve stroke it is mainly possible to enlarge the radius of the gripper pincers above the target radius. This makes it possible to compensate for inaccuracies, deformations and tolerances.

It is especially advantageous when operating in obscure regions if the individual bags of the pipe repository are allocated end or approach indicating elements or sensors monitoring the pivoting and sliding path. In this way, it is more easily possible to approach the specified target positions securely and rapidly and indeed as already stated even when the operator or operating team otherwise would easily be overtaxed owing to poor visibility conditions.

One telescoping cylinder each is appropriately allocated to the gripper whereby the two pincers of the gripper are coupled by a connecting shaft on which they can at the same time be movably arranged. In this way, different pipe lengths can be processed and a uniform motion or selective motion of the gripper pincers is assured.

The smooth and secure motion of the gripper elements is assured in that the sliding track is constructed in prismatic profile. By the use of a prismatic profile, the former state can be restored without great expense when wear and tear occurs so that a constant smooth and secure guidance on the sliding track is assured. The sliding track can also be mounted on the vertical element of the cross beam in order to avoid a settling of drilling or concrete residues. By adjusting the guides, inaccuracies arising with wear and tear can be rapidly eliminated again.

A clean hose guidance is assured since in accordance with the invention a hose guide is arranged on the sliding track, whereby a hose reel is connected with the outer pipe of the displacement cylinder. By connecting the hose reel to the outer pipe of the displacement cylinder, impairing the hoses in underground operation can be ruled out because they are always kept rigid.

With different pipes, i.e. pipe diameters, many or few pipes can be accommodated in the drill pipe holder. In order to ensure this also on the part of the construction of the bag or the drill pipe holder, it is provided that the individual bags of the pipe repository in the partial circle are exchangeable or are constructed alterable in their distance to one another. Thus one can either change the bags or move the bags in order thus to be able to accommodate 7, 8 or even more double pipes in the pipe repository or in the partial circle, or even exchange complete pipe depositories with bags.

The motions of the grippers or the pincers with and without pipes are possible in the specified directions of motion because a reciprocating oscillating motor with axial displacement is allocated to the telescoping cylinder. The reciprocating oscillating motor is moreover outfitted with a rotational angle monitoring unit for positioning the pipes so that the entire sequence of motion as already mentioned several times above can take place automatically, that is without the operating team having to intervene.

The invention is particularly distinguished in that a drilling machine with a drill pipe holder is created with which a hand sorting of inner and outer pipes need no longer take place. Rather, the combined actuation of outer and inner pipes or also their separate motion and shifting from one position into the other is possible. The drill pipe holder is constructed such that inner and outer pipes are arranged securely therein in a specified position so that they can then be securely grasped by the gripper and be removed from the bags of the drill pipe holder. Conversely, the pipes can also be separately threaded and inserted whereby they receive a positioning which assures sliding over one another and then subsequently secures grasping. It is furthermore advantageous that the drilling machine and drill pipe holder can be operated not only automatically, but can also be operated, through additional safety facilities, under unfavorable visibility conditions. The outer and inner pipes arranged in the drill pipe holder are grasped with one and the same gripping apparatus, and are indeed grasped separately in order to swivel them into the drilling axis and then to connect them with the drilling drive or the drilling rods. This gripper is constructed such that, for example, it at first recovers the inner pipes when pulling the drilling rod and places them in the drill pipe holder in order then to pull the outer pipes out in a subsequent operation, separate them from each another and set them over the inner pipes in the drill pipe holder or the appropriate bags. This way, the combined pipes, that is, outer pipe and inner pipe, are immediately available for the subsequent drilling process without a hand sorting being necessary at all. Sliding the outer pipes over the inner pipes is considerably facilitated by the motility of the gripper and above all owing to the specified position of the inner pipes and outer pipes in the bag. Both pipes then receive a specified end position after insertion, which is exactly the right one for subsequent drilling operations.

Further details and advantages of the object of the invention become apparent from the subsequent description of the associated drawings, in which a preferred embodiment with the necessary particularities and details is represented, wherein:

DETAILED DESCRIPTION OF THE PREFERRED EMBODIMENTS

Figure 1:
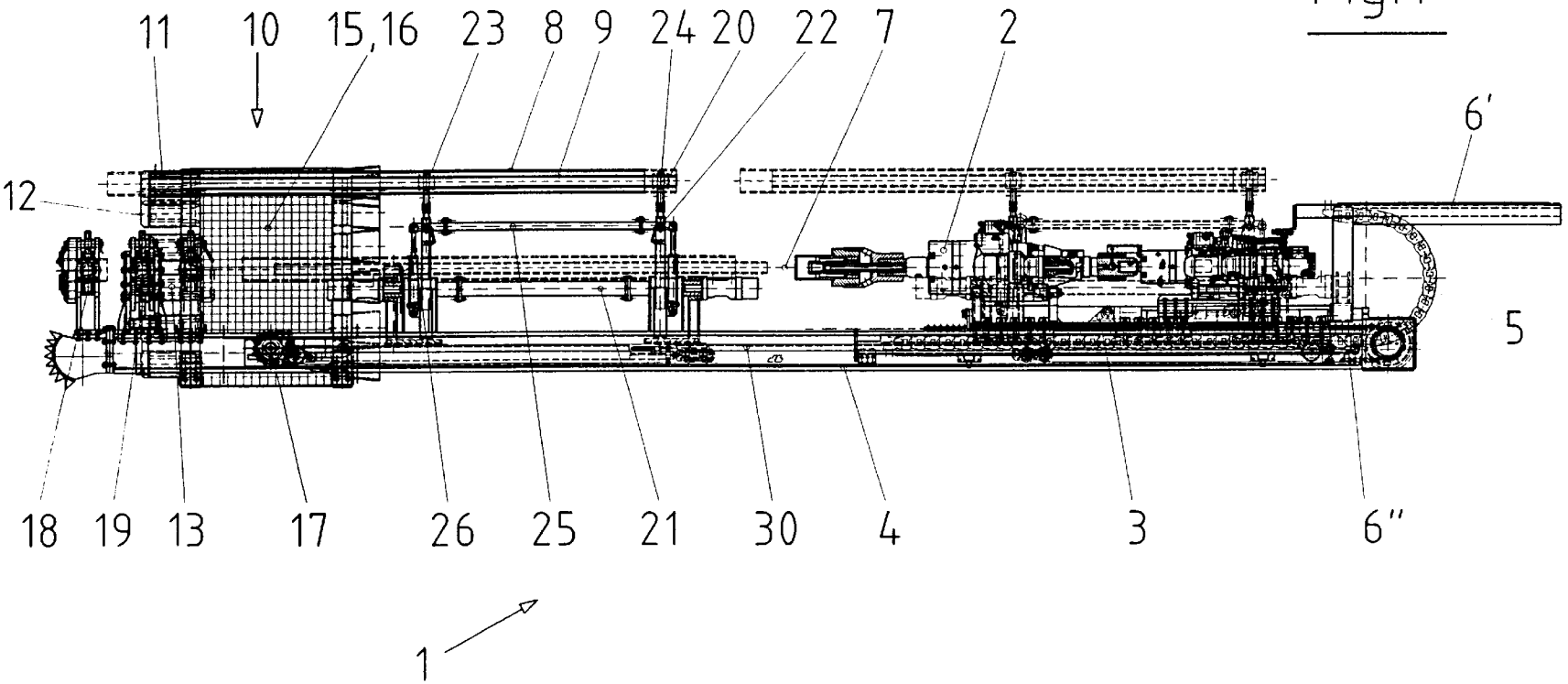
FIG. 1 Illustrates a drilling machine with arc-like drill pipe holders in side view, FIG. 2 Shows the gripper in two positions in a side view, FIG. 3 Reveals the front part of the drilling machine with the drill pipe holder, FIG. 4 Provides a section through the drilling machine in the region of the drill pipe holder, FIG. 5 Gives a partial side view of the drill pipe holder, FIG. 6 Depicts an end segment of the bag forming a pipe repository and FIG. 7 Presents a section through this end segment according to FIG. 6.

The drilling machine 1 disposes as usual over a drill drive 2, which is moved along a drilling unit 3 on a drilling unit beam 4, whereby through the particular power chain guide 6 a secure power supply is assured through the power chain 5.

The outer pipes 8 and the inner pipes 9 can be connected on the one hand with the head of the drill drive 2 in the drilling axis 7, on the other with the here not depicted drilling string situated in the mountain. For this, outer pipe and inner pipe 8, 9 are removed from the drill pipe holder 10 and swiveled with the aid of the gripper 20 about its axis 21 into the drilling axis 7. For this, they must nonetheless first of all be pulled out of the pipe depositories 11, 12, 13, the particular shape of which will be explained further below, for which reason FIG. 1 and above all also FIG. 2 show two positions which the gripper 20 can assume.

Figure 4:
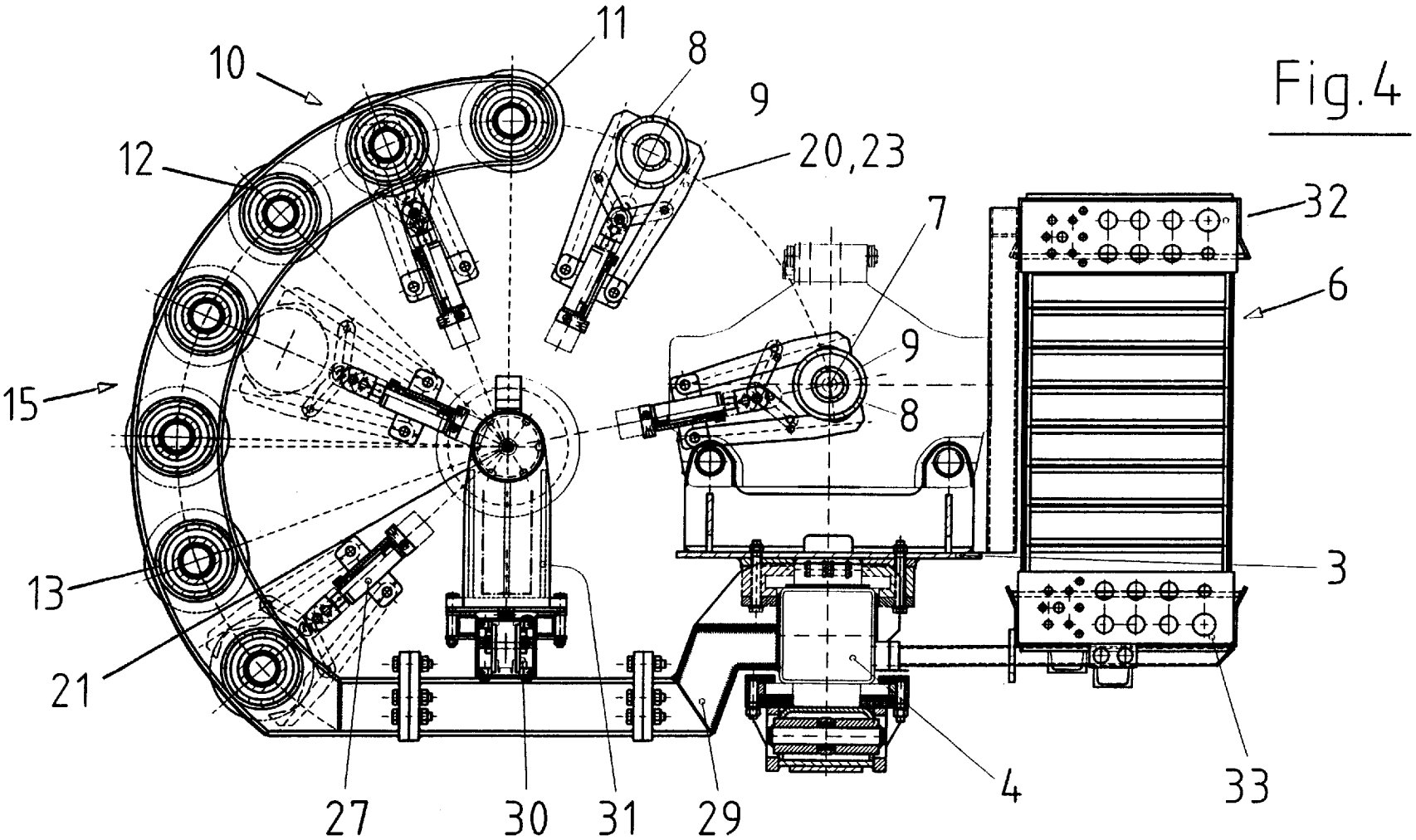

FIG. 4 in particular makes the special construction of the drill pipe holder 10 clear, which here describes a partial circle 15 and disposes over a perforated sheet bracing 16 in order to be able to accommodate securely the relatively heavy pipes 8, 9. This drill pipe holder 10 describes a partial circle 15 about the axis 21 of gripper 20 so that, with the gripper 20, the individual pipes can be securely grasped and pulled out of the pipe depositories 11, 12, 13. The moving of gripper 20 with the axis 21 and the supporting arm 22 takes place on a sliding track 30, specifically with the aid of a chain only indicated here, which is passed about the deflection 17. This deflection 17 has available a chain tensioner in order to also be able to specify the exact position of the gripper 20 at the same time.

Figure 2:
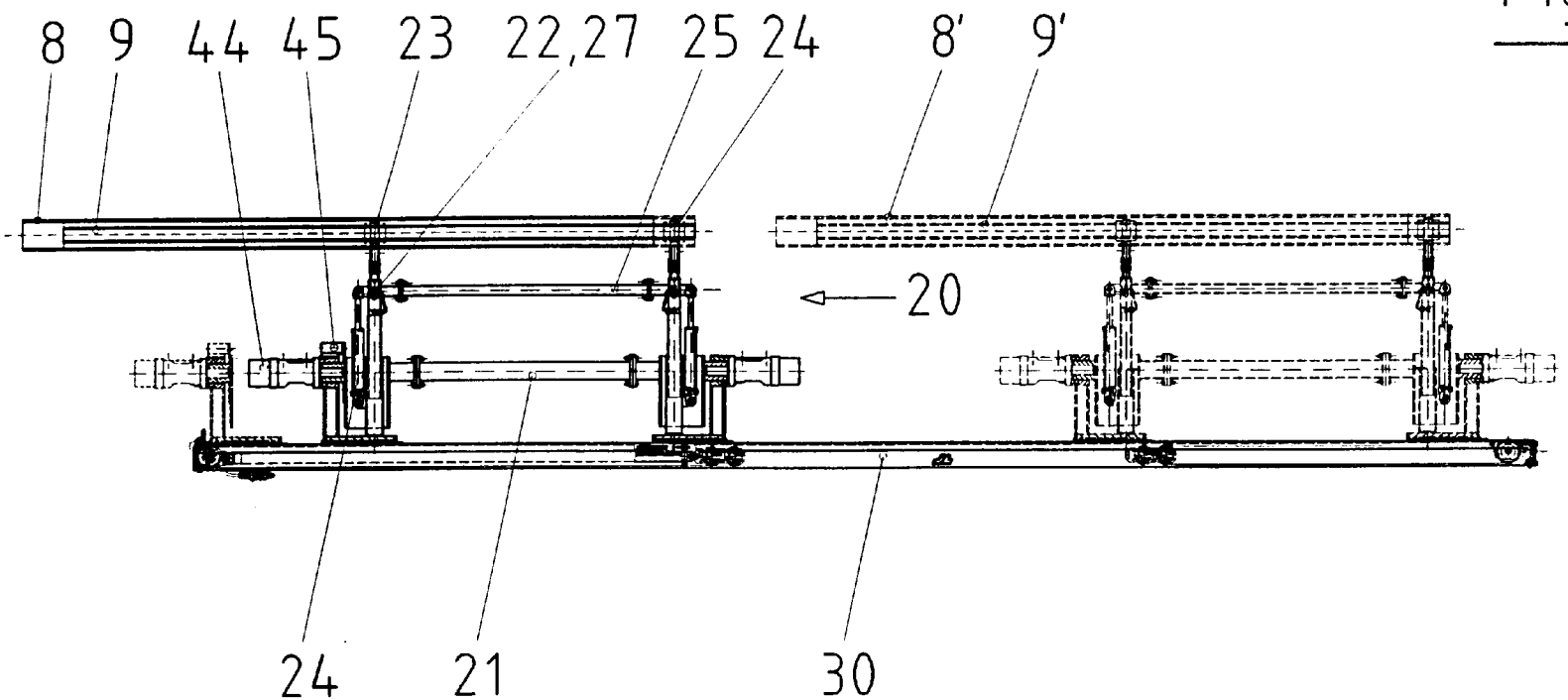

Recognizable in FIG. 1, but above all also in FIG. 2, is that the gripper 20 disposes over two pincers 23, 24 arranged at a distance, which are connected by a connection shaft 25. They have available a telescoping cylinder 26 so that they in any given case can be swiveled, for example, with the pipes 8, 9 into the boring axis 7. The corresponding cylinders 27 can be constructed as three position cylinders in order to be able to specify or maintain the necessary positions exactly.

The gripper 20 with pincers 23, 24 for grasping the individual pipes 8, 9 in the pipe depositories 11, 12, 13 can be rotated into the position necessary in each case through the reciprocating oscillating motors 44 with rotational angle monitoring 45 in order then, as stated, to grasp the pipes 8, 9 and remove them from the bag 34 or the pipe repository 11, 12, 13 and pivot them into the drilling axis 7.

Pipe dividing apparatuses are designated with 18 and 19, which serve to separate the pipes 8, 9 connected with each other from each other when pulling the pipes out of the finished bore hole in order to return them then into the drill pipe holder 10 with the gripper 20.

FIG. 2 shows the two positions, which the gripper can assume if it is to bring pipes 8, 9 or 8', 9' back and forth. It is also recognizable that and how the overall gripper 20 or the gripper structure with or if need be also without pipes 8, 9 can be moved back and forth, specifically on the sliding track 30.

Figure 3:
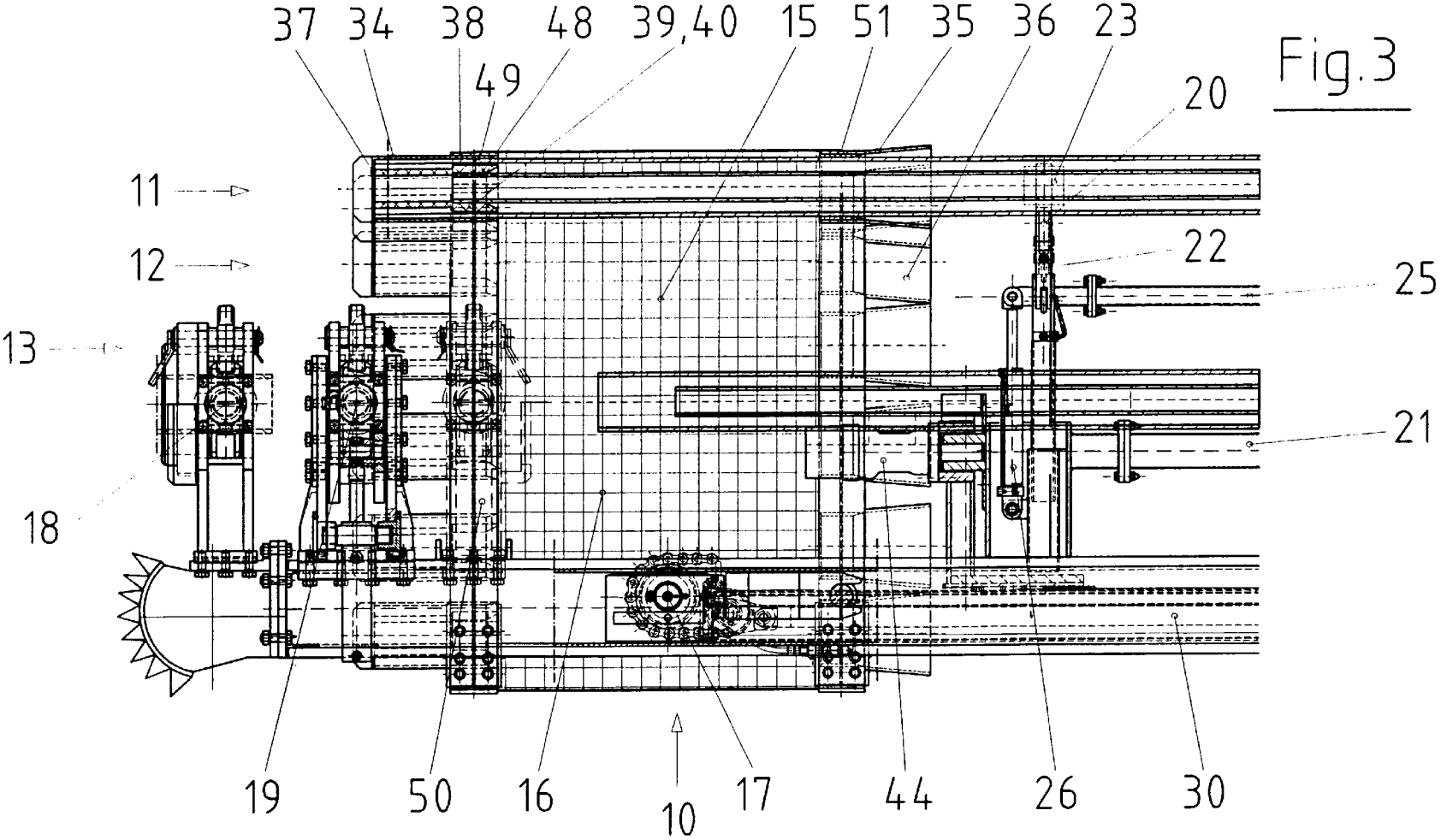

FIG. 3 shows the front area of the drilling machine 1 with the drill rod holder 10 in a side view. The funnels 36 arranged or formed at the entry end 35 of the bag 34 are clearly recognizable here. The funnels 36 facilitate insertion of the pipes 8, 9 into the bag 34. It is recognizable that several pipe depositories 11, 12, 13 of this type with the bags 34 are provided one above the other in a partial circle 15. It is recognizable at the very top that an outer pipe and an inner pipe 8, 9, are inserted so far that the inner pipe 9 has been slid forward up to the step mandrel 39 with the stopper 40, while the outer pipe 8 extends up to against the bag bottom 37. In this way, the inner pipe 9 appropriately extends far out of the outer pipe 8 at the opposite end where the gripper 20 must engage. The enclosure is designated with 48.

FIG. 4 makes clear that the individual pipe depositories 11, 12, 13 form a partial circle 15. In the embodiment represented, seven such pipe depositories 11, 12, 13 are present. According to pipe diameter, it is also possible to use eight or if need be even more such pipe depositories 11, 12, 13. These pipe depositories 11, 12, 13 have the form of a bag as is explained on the basis of FIG. 3, and chiefly on the basis of FIG. 5.

FIG. 4 moreover makes clear the construction of the gripper 20 or more exactly of the pincers 23 or 24, whereby with these pincers 23, 24, the inner pipe 9 with its smaller diameter as well as the outer pipe 8 with its larger diameter can be grasped. The right position depicts the transfer of these two pipes 8, 9 into the drilling axis 7 so that, with the aid of the drilling machine drive 2, the connection with the drilling string can be attained.

The gripper 20 is pivotable about the axis 21 while the supporting arm 22 is telescoping or has the form of a cylinder 27. The gripper 20 can be swiveled about the axis 22 with the here not shown reciprocating oscillating motor 44 in order to be able to assume the various positions indicated in FIG. 4, in order thereby to be moved onto the pipes 8, 9 so as to then pull the two pipes 8, 9 out of the bag 34 through a sliding motion on the sliding track 30. The sliding track 30 is allocated a cross beam 29, which is connected with drilling unit beams 4 and consequently forms a complete unit and assures that the gripper 20 can always be appropriately swiveled securely.

The sliding track 30 bears the axis 21 over the axis support 31, with which the entire gripper 20 can be slid axially toward drilling axis 7.

To the right alongside the drilling unit beam 4 with the drilling unit 3, the already mentioned power chain guide 6 is represented with its upper guide 32 and the lower guide 33.

Figure 5:
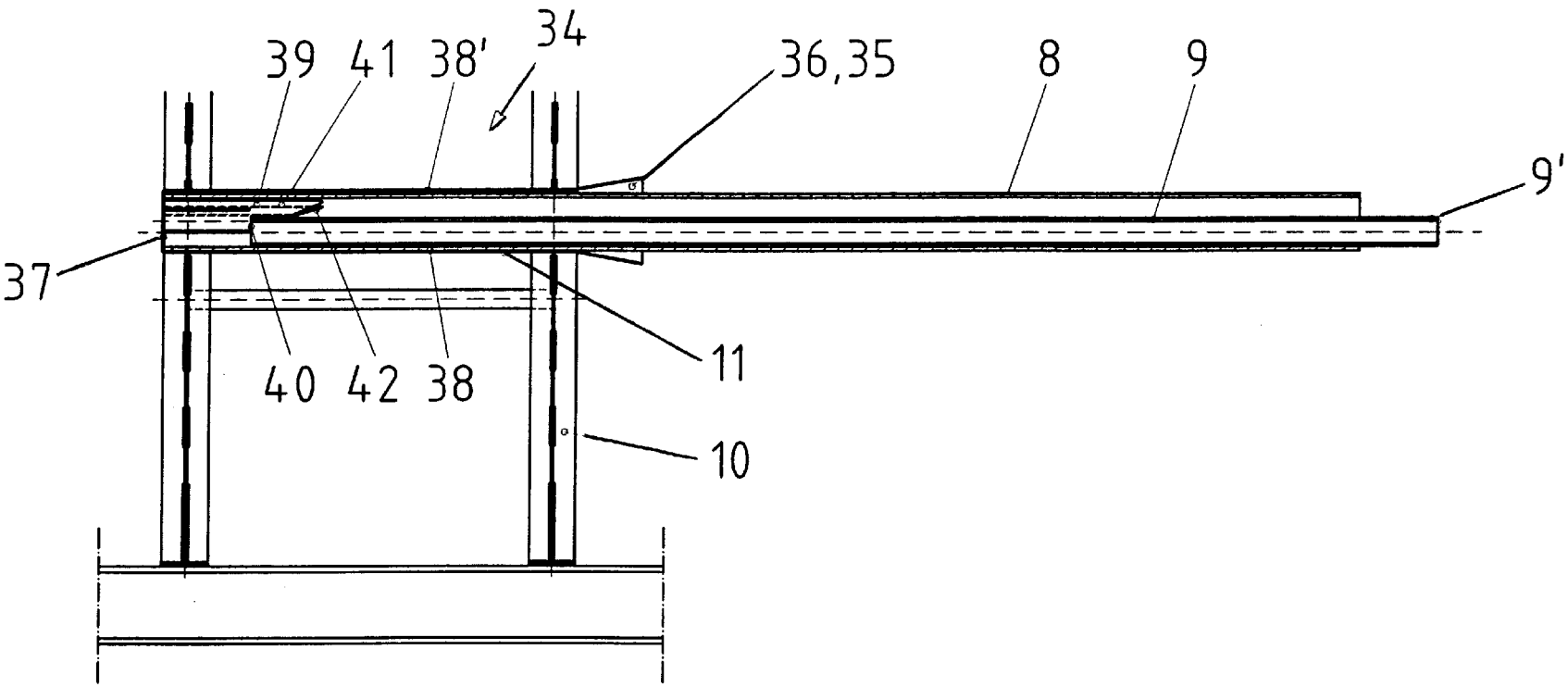

The upper pipe repository 11 indicated in FIG. 3 is represented in detail in FIG. 5. Here it is recognizable that the inner pipe 9, which is smaller in diameter, is guided by the step mandrel 39 in the direction of the bag wall 38 and is held by the stopper 40 so that the inner pipe 9 with its pipe end 9' projects appropriately far out of the outer pipe 8. If one considers that, when pulling the drilling string or pipe string, the inner pipes 9 are initially deposited in the bag 34 or the pipe repository 11, it becomes recognizable that one first of all obtains an exact arrangement and fixation in place of this inner pipe 9 owing to the special construction of the step mandrel 39. This way then the outer pipe 8 can more easily be slid over, whereby it then receives exactly the specified end position because it is advanced up to the bottom of the bag 37. Additional guides for the outer pipe 8 are provided to the side of the step mandrel 39 whereby one can also designate these guides as adjusting element 41. The tip of step mandrel 39 contains a pipe guide 42, with which it is ensured that the inner pipe 9 is pushed down during insertion into the bag 34. The representation according to FIG. 5 makes clear that the outer as well as above all the inner pipes 8, 9 are guided and braced in the bag 34 or the pipe depositories 11, 12, 13 such that the gripper 20 (not represented here) can securely grasp the two pipes 8, 9 and can seize them for further operations because they do not sag, do not slip against each other and maintain the exactly specified position, which grasping and swiveling by the gripper 20 ensure. The support-reinforcements 43, which are particularly apparent on the basis of FIG. 7, are present in order to reinforce the individual pipe guides 42 or the adjusting elements to ensure that they are not pressed or bent out of position when inserting the pipes 8, 9.

Figure 6:
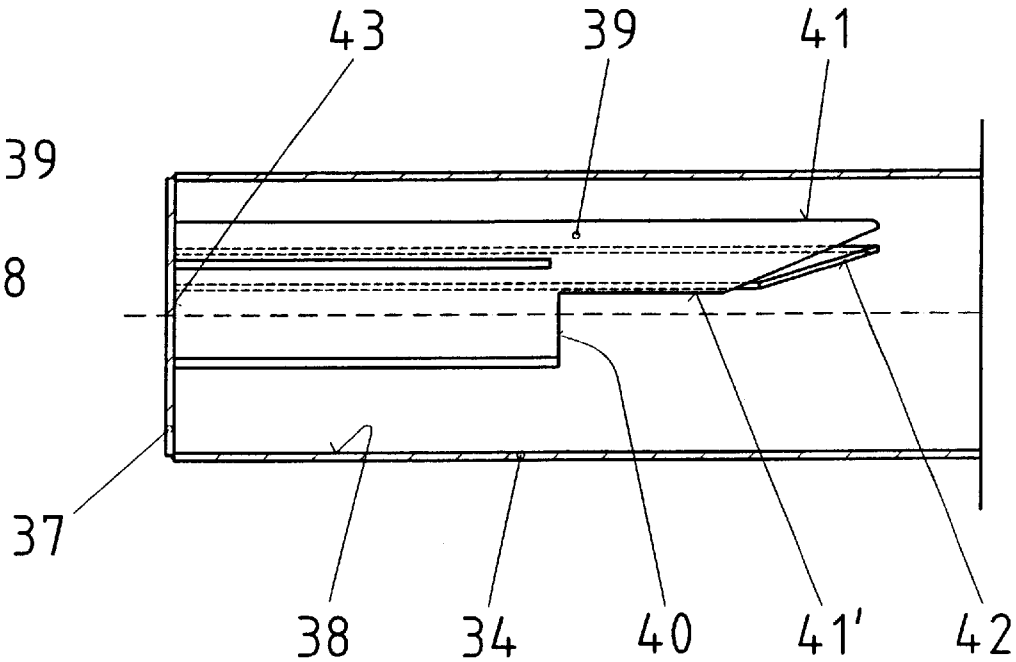

FIG. 6 in particular depicts the pipe guide 42, which assures that the inserted inner pipe 9, which is not represented here, is pressed downward onto the bag wall 38. FIG. 7, and above all FIG. 5, also show corresponding material, whereby after pressing down and therewith in an exactly fixing manner, the adjusting element 41' also once again ensures that the inner pipe 9, which projects appropriately far out of the bag 34, is securely guided and mounted in bag 34.

Figure 7:
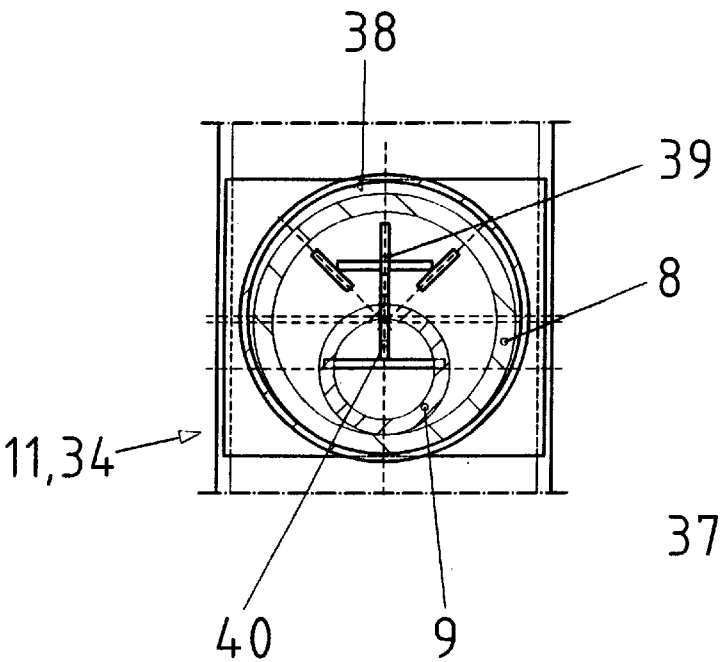

FIG. 7 shows a section through the posterior end of the bag 34 or pipe repository 11, where it is once again recognizable that even with the inserted pipes 8, 9, the inner pipe 9 rests with its bottom on the outer pipe 8, for which the pipe guide 42 remains responsible along with the adjusting element 41.

FIG. 3 shows a representation deviating from that of FIG. 5 with respect to the specific mounting of inner and outer pipes 9, 8, as here no step mandrel is realized in that sense, but rather an enclosure as an early stop for the inner pipe 9 and a selective bushing 49 for the outer pipe 8 in the region of the first guide segment 50 of the drill pipe holder 10. In this design, the outer pipe 8 is then pushed in accordance with FIG. 3 through to the bottom of the bag 37, while the inner pipe 9, as already mentioned, is previously stopped. Depending on the length of the pipes 8, 9 and their weight, or even with a construction with only one pipe 8, this short partial segment would suffice for guiding and depositing the pipe 8, and possibly also pipe 9, i.e. the guide segment 51 with funnels 36 arranged at a distance to this is above all useful and necessary if appropriately long pipes 8, 9 and especially both pipes 8, 9 are used.

All features mentioned, also those to be inferred from the drawings alone, are viewed as basic to the invention alone and in combination.

We claim:

1. A drill for double-head and overlap drilling comprising a drill driving gear, a mount for guiding said gear while the gear is being shifted longitudinally a drill string comprising single tubes, a rod magazine shaped to form an arced track, a gripping device coupled to the rod magazine for transporting the tubes out of the rod magazine into a drilling axis and back, the gripping device being rotatable around an axis and comprising a telescoping support arm, the gripping device being movable axially relative to the mount, the rod magazine comprising quiver-shaped, fixed tube storage receptacles around the axis of the gripping device, the receptacles being distributed at spaced intervals on a graduated circle, said storage receptacles being suitable for accommodating single tubes and double tubes, said double tubes comprising exterior and interior tubes, and said storage receptacles fixing said tubes in position.

2. The drill of claim 1, further comprising a drilling unit beam and cross-beams connecting the gripping device to the drilling unit beam, wherein the axis of the gripping device is alongside the drilling unit beam and the gripping device is arranged displaceably on a sliding track coupled to the cross beams parallel to the drilling axis or the drilling unit beam.

3. The drill of claim 1, wherein the receptacles comprise a step mandrel in a drill pipe holder opposite an entry end for the tubes.

4. The drill of claim 3, wherein the step mandrel for an inner pipe comprises a stopper projecting from a bottom of the receptacle and further comprises pipe guides.

5. The drill of claim 4, wherein the step mandrel is formed for guiding the inner pipe along a wall of the receptacle.

6. The drill of claim 5, wherein the wall is coupled to adjusting elements for fixing a position of an outer pipe.

7. The drill of claim 4, wherein the step mandrel is exchangeably connected to the bottom of the receptacle.

8. The drill of claim 4, wherein the receptacles for accommodating the tubes is widened forming a funnel on an end opposite the bottom of the receptacle.

9. The drill of claim 1, further comprising pincers, wherein the gripping device is disposed over two pincers positioned at a spaced distance from each other for securely seizing tubes having different diameters, the gripping device being simultaneously displaceable parallel to the drilling axis and being actuatable jointly or separately.

10. The drill of claim 9, wherein the gripping device and the two pincers are disposed at a distance and are each coupled to a telescoping cylinder.

11. The drill of claim 10, further comprising a connection shaft for coupling the two pincers to each other, and wherein the pincers are displaceably arranged on the connection shaft.

12. The drill of claim 1, further comprising cylinders coupled to the gripping device and wherein the cylinders are three-position cylinders with reserve stroke.

13. The drill of claim 1, further comprising end or approach indicator elements or sensors coupled to individual receptacles of the rod magazine for monitoring pivoting or sliding path of the gripping device.

14. The drill of claim 1, further comprising a sliding track comprising a prismatic contour.

15. The drill of claim 14, further comprising a hose guide on the sliding track and a hose reel connected to an outer pipe of a sliding cylinder.

16. The drill of claim 1, wherein individual receptacles of the rod magazine are constructed interchangeably in a partial circle and are alterable in distance from one another.

17. The drill of claim 1, further comprising a telescoping cylinder coupled to a reciprocating oscillating motor with axial displacement.

18. The drill of claim 1, wherein the reciprocating oscillating motor comprises an angle of rotation monitoring unit for positioning the tubes.

* * * * *